United States Patent [19]

Michaux

[11] 4,400,962

[45] Aug. 30, 1983

[54] IMPROVED ROLLING MILLS APPARATUS FOR ROLLING RAILS WITH UNIVERSAL AND EDGING PASSES WHEREIN EDGING PASSES ARE MADE IN A REVERSING UNIVERSAL FINISHING STAND

[75] Inventor: Jacques M. Michaux, Joeuf, France

[73] Assignee: Sacilor Acieries et Laminoirs de Lorraine, Hayange, France

[21] Appl. No.: 300,913

[22] Filed: Sep. 10, 1981

[30] Foreign Application Priority Data

Sep. 15, 1980 [FR] France ..... 80 19853

[51] Int. Cl.[3] ..... B21B 1/08

[52] U.S. Cl. ..... 72/222; 72/225; 72/234

[58] Field of Search ..... 72/199, 221, 222, 226, 72/227, 228, 234, 235, 365, 366

[56] References Cited

U.S. PATENT DOCUMENTS

| | | | |
|---|---|---|---|
| 341,570 | 5/1886 | Graham | 72/221 |
| 410,821 | 9/1889 | Colley | 72/221 |
| 938,197 | 10/1909 | York | 72/366 |
| 1,228,782 | 6/1917 | Kernohan et al. | 72/222 |
| 1,546,025 | 7/1925 | Rendleman | 72/234 |
| 1,602,968 | 10/1926 | Farkell | 72/221 |
| 3,342,053 | 9/1967 | Stammbach | 72/226 |
| 3,538,732 | 11/1970 | Noda et al. | 72/226 |
| 4,370,877 | 2/1983 | Michaux | 72/222 |

FOREIGN PATENT DOCUMENTS

| | | |
|---|---|---|
| 471152 | 7/1929 | Fed. Rep. of Germany . |
| 2534647 | 4/1975 | Fed. Rep. of Germany . |

*Primary Examiner*—Lowell A. Larson
*Assistant Examiner*—Jonathan L. Scherer
*Attorney, Agent, or Firm*—Schroeder, Siegfried, Vidas & Arrett

[57] ABSTRACT

The set of horizontal rolls or the set of horizontal and vertical rolls of a universal stand, especially a finishing stand for universal rolling of rails or like sections has, in addition to the finishing grooves, grooves other than universal or finishing grooves, preferably edging grooves.

6 Claims, 8 Drawing Figures

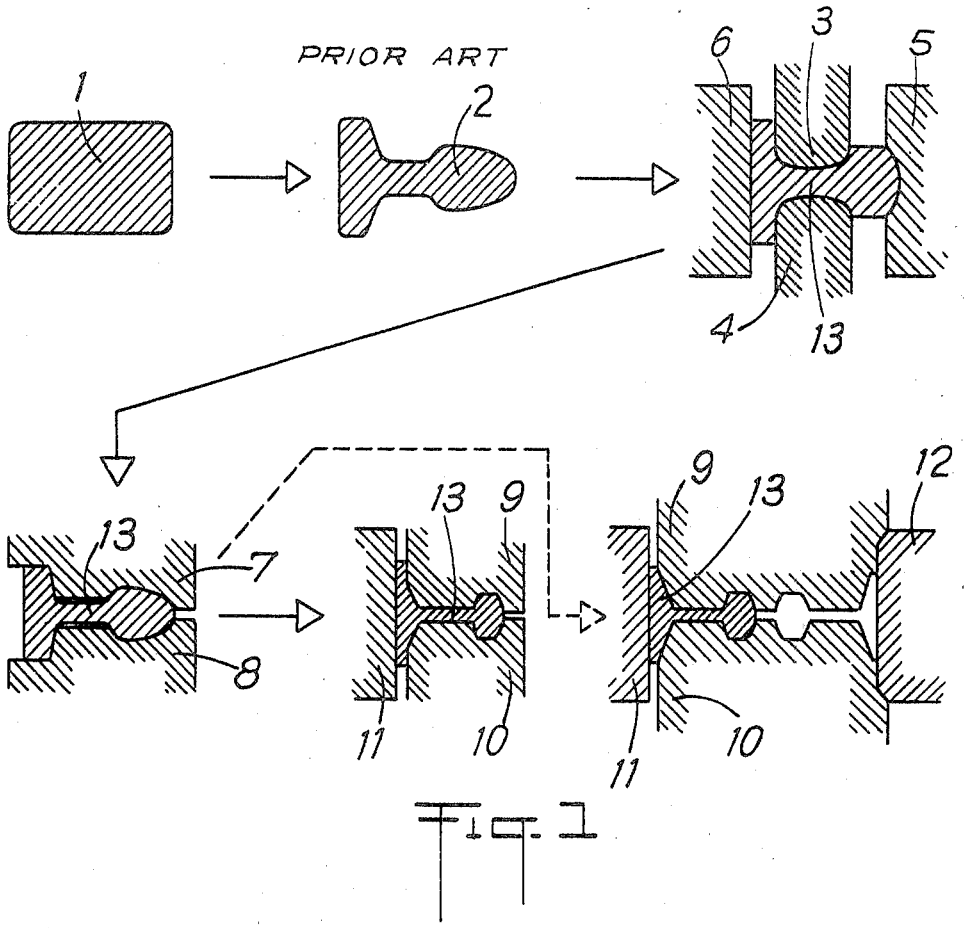
FIG. 1
FIG. 2
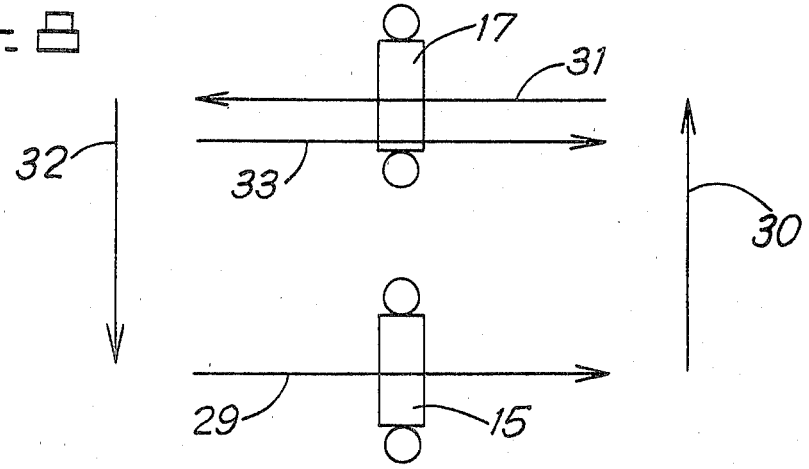

IMPROVED ROLLING MILLS APPARATUS FOR ROLLING RAILS WITH UNIVERSAL AND EDGING PASSES WHEREIN EDGING PASSES ARE MADE IN A REVERSING UNIVERSAL FINISHING STAND

The invention relates to a method for arranging open grooves on the rolls of a universal or a semi-universal stand, particularly a finisher, for profiles such as rails, the stand being of the type comprising two horizontal rolls and one or two vertical rolls.

The invention is also concerned with rolls, stands and rolling mills provided with such grooves.

U.S. Pat. No. 3,342,053 discloses a universal finishing stand of the aforementioned type comprising one or two finishing grooves; such a stand, mounted, for example, on a turntable, can, by a 180° rotation of the stand, present a reserve finishing groove in the rolling line after wearing out the first groove. It should be mentioned that the groove changeover is only possible by stopping the mill. It cannot be done while rolling is in process. The only advantage of this type of stand is to offer a reserve finishing groove. Installing this stand does not change in any way the arrangement of the rest of the universal rolling mill and, in particular, does not affect at all the number of universal stands and edging stands to be provided.

The aim of the invention is to make better use of the finishing stand, as far as possible depending on the circumstances, either omitting an edging stand from the rolling mill or improving the quality of the rails by making more edging passes or other passes in grooves specifically adapted to the passes that are performed in them.

This aim is achieved with the present invention by means of a method of locating, besides finishing grooves, open grooves other than universal or finishing grooves on the same set of horizontal and vertical rolls of a universal or semi-universal stand, especially a finishing stand.

According to an advantageous manner of carrying out the process, at least one edging groove is positioned on the horizontal rolls of a universal or semi-universal stand used in finishing rails or like profiles. One can also locate on at least one end of the horizontal rolls another edging groove so that the part of said groove corresponding to an edging pass cooperates with one of the vertical rolls of the universal stand; in this way, one gets a groove for a universal semi-edging pass.

It is particularly interesting to locate in the same set of horizontal rolls of a universal stand, particularly a finishing stand, at least two overlapping edging grooves in such a way that their medial planes are distinct from the longitudinal vertical rolling plane and parallel to it.

For an existing universal mill, devised for rolling beams, to be adapted for universal rolling of rails, the use of a stand to carry out the method of the invention permits a reduction in the necessary rearrangements in that it utilises the available or possible barrel length of the installed universal finishing stand for accommodating the supplementary edging grooves needed to carry-out the method of universal rolling of rails.

Other advantages will be evident from the description of a finishing stand of the invention with reference to the following figures:

FIG. 1 shows the different steps in universal rolling of a rail in the prior art, on transverse section of the rolling line;

FIG. 8 shows a schematic plan view of another embodiment of a rolling mill according to the invention.

Figure 2:
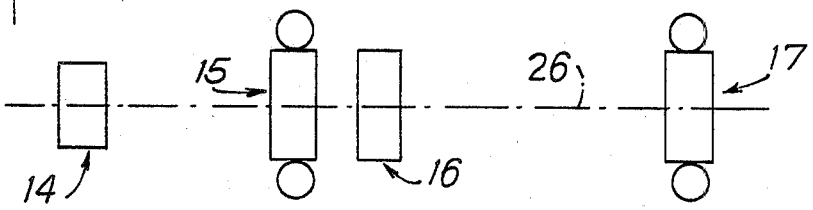
FIG. 2 PRIOR ART
FIG. 2 shows a schematic plan view of one of the prior art types of universal mill for rails.

In the universal rolling of rails according to U.S. Pat. No. 3,342,053, carried out, for example, on a reversing universal rolling mill, a bloom 1, such as shown in FIG. 1 in transverse section, is rolled into a blank 2 also shown in transverse section, by a rolling mill (not shown). This blank 2 is then rolled by successive passes in one or more universal stands, comprising two horizontal rolls 3 and 4 and two vertical rolls 5 and 6, and in one or more edging stands comprising two horizontal rolls 7 and 8, to be finished off in a finishing stand comprising two horizontal rolls 9 and 10 and a vertical roll 11, the other vertical roll 12 not being used for the universal rolling of the rail, but being used after rotation of the stand by 180°. The finishing stand can also be semi-universal as shown in FIG. 1 and in this case only have two vertical rolls 9 and 10 and one horizontal roll 11. The rail is shown in the course of rolling by its transverse section 13, held in the horizontal rolls and a vertical roll. In its simplest form, a reversing universal rolling mill, such as shown in U.S. Pat. No. 3,342,053 carrying out the universal rolling process, comprises, as shown in FIG. 2, a cogging or break-down mill 14 comprising one or more stands for forming the blank 2 from the bloom 1, a reversing universal stand 15, a reversing two-high edging stand 16 and a universal or semi-universal finishing stand 17. The distribution of the passes thereby is as follows: LP-$U_1$-$E_1$-$U_2$-$U_3$-$E_2$-$U_4$-$U_5$-$E_3$-F where the pass forming the blank 2, also called the leader-pass, is denoted by LP. Each universal pass is denoted by the letter U and each edging pass by the letter E, the finishing pass being denoted by the letter F. An underlined letter denotes that the pass is effected in a specific groove, adapted exactly for the pass concerned. A letter which is not underlined signifies here and in the remainder of the description that the pass is made in a groove which is adjusted by screwing down the rolls. In the prior art such as described in U.S. Pat. No. 3,342,053 the blank 2 enters the stand 15 where it undergoes a universal pass U; then into the edging stand 16 where it undergoes a first, perfectly fitting edging pass $E_1$. The rail 13 is passed again in the stand 16 then in the stand 15 to undergo in this latter the pass $U_2$, obtained by screwing down the horizontal rolls 3 and 4 and the vertical rolls 5 and 6. After the rail goes through the pass $U_2$, the horizontal and vertical rolls of the stand 15 is screwed down again and the rail is passed in the universal stand 15 for the universal pass $U_3$. The rail then passes in the edging stand 16 where it undergoes the edging pass $E_2$ formed by screwing down the horizontal rolls 7 and 8. The geometry of the groove of the edging pass $E_2$ is not exactly fitted to the pass that is performed there. Finally the rolling is terminated by a pass in a universal finishing stand having one or two grooves so as to get the precise final dimensions. The fact that the geometry of the grooves is not perfectly adapted to the passes that have to be done in the reversible stands, which are universal of two-high edging stands, is a well-known feature of reversing mills. This inconvenience is accepted because it is compensated for by considerable advantages such as the reduction in the number of stands required and the surface area necessary for the construction of the mill. The suppression of the inconveniences of a reversing rolling mill as described above and shown in FIG. 2 would require its replacement by a continuous mill comprising at least as many universal stands and edging stands as there are passes.

In the finishing stand according to the invention, there is in addition to the one or two finishing grooves, at least one edging groove.

Figure 3:
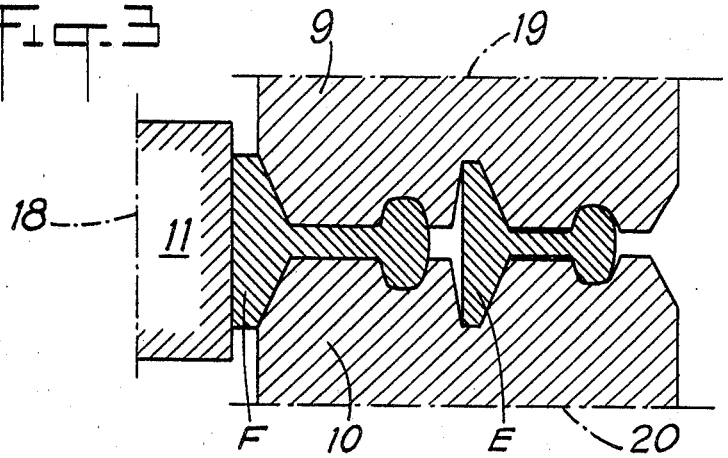
FIG. 3 shows a transverse section of a universal finishing-edging stand according to the invention.

FIG. 3 shows, in transverse section, a finishing stand according to the invention, comprising a vertical roll 11 rotating about its vertical axis 18 and two horizontal rolls 9 and 10 working in the same plane and rotating about their respective horizontal axes 19 and 20. The rolls 9, 10 and 11 form a finishing groove F and the rolls 9 and 10 alone, an edging groove E. For better understanding, there is shown in the same FIG. 3 two rail sections engaged for rolling in two distinct passes F and E, but it should be understood that in the course of one specific pass F or E, only one groove receives the rail.

The feeding of sections to a given groove (the edging groove or the finishing groove) can be done in different ways; by transverse displacement of the whole stand or of the horizontal rolls to bring the appropriate groove into alignment with the rolling line; or by locating in front of the stand, either a guiding-switch system which deviates the rail from the rolling line towards an appropriate groove or equally by an arrangement with side-guards movable laterally, the stand remaining fixed. The reinsertion of the rail into the general rolling line after a pass in an appropriate groove can be done in the same way.

The use in the rolling mill of FIG. 2 of a universal finishing stand according to the invention, such as shown in FIG. 3, allows a supplementary edging pass to be performed with a second specific edging groove located in the finishing stand.

Figure 4:
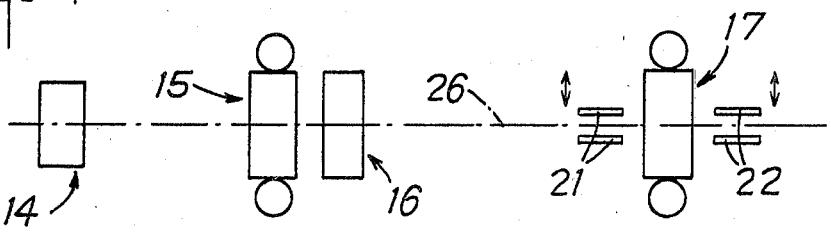
FIG. 4 shows a schematic plan view of a rolling mill according to the invention.

FIG. 4 shows a novel rolling mill according to the invention, where, from upstream to downstream of the rolling line are found: the cogging or breakdown stand or stands 14, the universal stand 15, the edging stand 16, the upstream guiding system 21, the finishing stand 17 of FIG. 3, the downstream guiding system 22. The following distribution of passes can be made: LP-$U_1$-$E_1$-$U_2$-$U_3$-$E_2$-$U_4$-$U_5$-$E_3$-F which differs from the preceding distribution of passes in the fact that the edging pass $E_3$ is carried out in a groove specifically adapted to this pass. This novel distribution gives a better quality rolled product.

Figure 5:
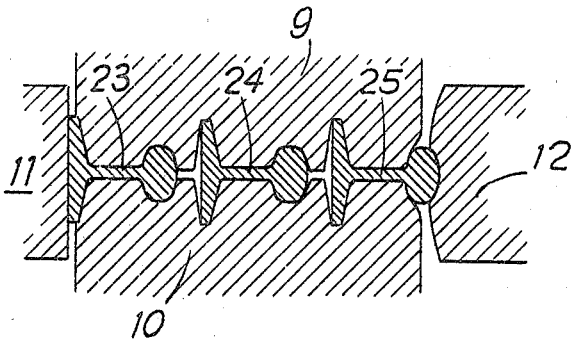
FIG. 5 shows a transverse section of a second embodiment of a universal finishing-edging stand according to the invention.

One could equally place on and at the edge of the rolls of a universal finishing stand another type of groove, as shown on FIG. 5. The finishing stand of FIG. 5 comprises two vertical rolls 11 and 12 and two horizontal rolls 9 and 10 forming three grooves 23, 24 and 25. The groove 23 is the state-of-the-art finishing groove, the groove 24 is the one for an edging pass according to the invention and the groove 25 is the one for a semi-universal edging pass according to the invention.

The use in the reversible rolling mill of FIG. 4 of such a finishing stand having three types of groove, as well as means for connecting any one of said grooves with the rolling line 26 allows the inclusion of supplementary grooves specific to the passes to be made in them, and eliminates such inconveniences as mentioned above for reversing mills of the prior art.

One can adopt, for example, the following distribution of passes: LP-$U_1$-$E_1$-$U_2$-$U_3$-$E_2$-$E'_3$-F where the universal passes $U_1$, $U_2$, $U_3$ (see FIG. 4) are made in the reversing universal stand 15. The specific edging pass $E_1$ is made in the edging stand 16. The specific edging pass $E_2$ (in the groove 24, see FIG. 5), the universal semi-edging pass $E'_3$ (in the groove 25) and the finishing pass F (in the groove 23) are made in a universal finishing stand according to the invention.

One can also have the following variant: LP-$U_1$-$E_1$-$U_2$-$U_3$-$E_2$-$U_4$-$U_5$-$E'_3$-F where the universal passes $U_1$, $U_2$, $U_3$, $U_4$, $U_5$ are made in the universal stand 15; the specific edging pass $E_1$ is made in the edging stand 16. In the finishing stand 17 of the invention, the specific edging pass $E_2$ (groove 24), the universal semi-edging pass $E'_3$ (groove 25) and the finishing pass F (in the groove 23) can be made.

Figure 6:
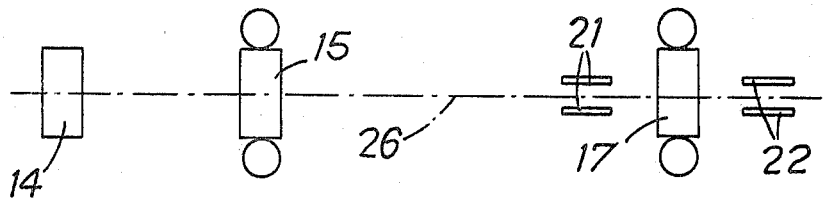
FIG. 6 shows a schematic plan view of a second embodiment of a rolling mill according to the invention.

The use of the same finishing stand having the three types of grooves of FIG. 5, can also allow the edging stand 16 to be completely dispensed with from a rolling mill according to FIG. 4 so as to get the rolling mill of the invention according to FIG. 6 which only has the breakdown mill 14, the reversing universal stand 15 and the reversing finishing stand 17 according to the invention, with its guiding systems 21 and 22 permitting lateral displacement of the rolling line 26 for feeding the rail in turn to the appropriate groove.

On this mill one can adopt, for example, the following distribution of passes: LP-$U_1$-$E_1$-$U_2$-$U_3$-$E'_2$-F where the universal passes $U_1$, $U_2$, $U_3$ are made in the universal stand 15; the specific edging pass $E_1$ (in groove 24), the universal semi-edging pass $E'_2$ (in the groove 25) and the finishing pass F (in the groove 23) are made in the reversing universal finishing-edging stand 17 of the invention.

One can also construct a finishing-edging stand according to the invention in which more than two edging grooves are located on the rolls of the universal finishing-edging stand. In the particular, one can, according to a method disclosed in another invention of the Applicant relating to edging stands, overlap several edging grooves one inside the other in order that their median planes are distinct and parallel to the longitudinal vertical rolling plane.

Figure 7:
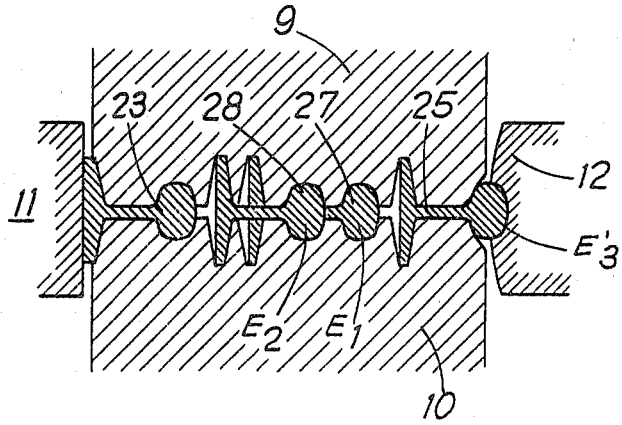
FIG. 7 shows a transverse section of a third embodiment of a universal finishing-edging stand according to the invention.

FIG. 7 shows a universal finishing-edging stand of the invention having two vertical rolls 11 and 12 and two horizontal rolls 9 and 10 bearing four grooves. Two edging grooves 27 and 28 are overlapped and serve respectively for edging passes $E_1$ and $E_2$. To assist understanding, the four sections to be rolled are shown together in the grooves.

The use of the universal finishing-edging stand of the invention shown in FIG. 7 in the rolling mill according to FIG. 6 allows the following distribution of passes: LP-$U_1$-$E_1$-$U_2$-$U_3$-$E_2$-$E'_3$-F where the universal passes $U_1$, $U_2$, $U_3$ are made in the universal stand 15. The specific edging passes $E_1$ and $E_2$, the universal semi-edging pass $E'_3$ and the finishing pass F are made in the universal finishing-edging stand 17 according to the invention, respectively in the grooves 27 and 28, 25 and 23.

It is to be understood that one can overlap more than two edging grooves in the universal finishing-edging stand even if it entails increasing the barrel length of the rolls of this stand. In that case one obtains new possible distributions of passes.

The invention has been illustrated in the framework of a reversing rolling mill, but it can equally be adapted to a continuous rolling mill, where it allows the elimination of an edging stand in exchange for a slight loss of hourly production capacity which follows from the need to make the finishing stand reversible.

In another connection, the invention described for the in-line rolling mill applies equally to the cross-country or other types of mill. For example, the invention could equally well be applied to a rolling mill in which a universal stand 15 and a universal finishing or semi-universal edging stand 17 of the invention are, for example, placed side-by-side as shown in FIG. 8. The cogging or break-down stands, which are not shown in this figure, can be placed at an appropriate position. In this disposition of the stand, or a similar arrangement in which it is not aligned as shown in FIG. 8, the stands 15 and 17 may be non-reversible, may both be reversible, or one may be reversible and the other not. With such an arrangement the widest range of possibilities for variants is offered, there being described here but one in which the rail is rolled in a universal stand 15 of the state-of-the-art, in the direction indicated by the arrow 29. The rail undergoes here the appropriate number of universal passes. After each universal pass, or after the required number of universal passes, the rail is transferred, by known means such as dogs, switch, guides, etc. shown symbolically by the arrow 30, to be fed in opposite the appropriate edging groove where it undergoes the required number of edging passes, all shown symbolically by the arrow 31. After each edging pass, the rail is transferred by known means, represented symbolically by the arrow 32, to be once again upstream of the universal stand 15, in order to undergo another universal pass, then opposite the finishing groove in the stand 17, in order to undergo a finishing pass represented by the arrow 33. A layout of the mill as shown in FIG. 8, where the stands are placed side-by-side (or a similar disposition where the rolling lines of the stands are not collinear) allows a large variety of distributions of passes. It allows, for example, to have always a universal pass be followed by a specific edging pass, made in a specific groove, when the universal or semi-universal finishing stand is also an edger according to the invention. The rolls of this cage 17 according to the invention can carry, besides the finishing pass, an edging groove (as in FIG. 3), or even a plurality of separate edging grooves placed side-by-side, or even a plurality of overlapping edging grooves such as the grooves 27 and 28 of FIG. 7, or even a plurality of separate groups of overlapping edging grooves, or equally a mixture of edging grooves and groups of overlapping edging grooves. One can imagine, for example, the following distribution of passes, without being limited to this example:

$U_1$-$E_1$-$U_2$-$E_2$-$U_3$-$E_3$-F $U_1$-$E_1$-$U_2$-$E_2$-$U_3$-$E_3$-$U_4$-$E_4$-F

One can thus add edging grooves to provide as many specific edging passes as required and as permitted by the length of the horizontal rolls of the semi-universal or universal stand 17 of the invention and it is readily understood that one can also obtain the following distribution of passes:

$U_1$-$E_1$-$U_2$-$U_3$-$E_2$-F $U_1$-$E_1$-$U_2$-$U_3$-$E_2$-$U_4$-$E_3$-F if one makes the rail pass at least twice in the universal stand before it undergoes an edging pass The layout of the mill of FIG. 8 is remarkably appropriate to the modification of a conventional two-high or three-high mill for the universal rolling of rails. It would be sufficient, for example, to add a universal stand 15 and to modify an existing two-high or three-high stand by mounting a vertical roll for the finishing pass.

What is claimed is:

1. An improved rolling mill for rolling rails from a rail blank, with universal and edging passes, including one universal finishing stand having two horizontal rolls and at least one vertical roll to provide a semi-universal finishing groove, said rolling mill further including at least a reversing universal stand and a reversing edging stand providing a single edging groove further including a means to align the rail blank with grooves with all said stands being arranged along a straight line, wherein the improved rolling mill comprises:

at least one reversing edging stand for forming a single edging groove;

at least one reversing universal stand, said reversing universal finishing stand including means for forming a semi-universal finishing groove and at least one edging pass formed by at least one edging groove made in the horizontal rolls; and means for aligning the rail blank with the groove of the reversing universal finishing stand selected to roll it.

2. An improved rolling mill according to claim 1 in which the reversing universal finishing stand further includes a semi-universal edging pass, said semi-universal edging pass being provided by a groove made in the two horizontal rolls and in a second vertical roll.

3. An improved rolling mill according to claim 1 in which the edging grooves provided by the reversing universal finishing stand comprise at least a set of two overlapping edging grooves which have distinct median planes.

4. An improved rolling mill for rolling rails from a rail blank, with universal and edging passes, including one universal finishing stand having two horizontal rolls and at least one vertical roll to provide a semi-universal finishing groove, said rolling mill further including at least a reversing universal stand, further including means to align the rail balnk with grooves with all said stands being arranged along a straight line, wherein the improved rolling mill comprises:

at least one reversing universal stand;

a reversing universal finishing stand for providing a semi-universal finishing pass as well as at least one edging pass provided by at least an edging groove formed in the horizontal rolls; and means for aligning the rail blank with the groove of the reversing universal finishing stand selected to roll it.

5. An improved rolling mill according to claim 4 in which the reversing universal finishing stand further provides a semi-universal edging pass, said semi-universal edging pass being provided by a groove made in the two horizontal rolls and in a second vertical roll.

6. An improved rolling mill according to claim 4 in which the edging grooves provided by the reversing universal finishing stand comprise at least a set of two overlapping edging grooves which have distinct median planes.

* * * * *

UNITED STATES PATENT AND TRADEMARK OFFICE

CERTIFICATE OF CORRECTION

PATENT NO. : 4,400,962

DATED : August 30, 1983

INVENTOR(S) : JACQUES MARIE MICHAUX

It is certified that error appears in the above-identified patent and that said Letters Patent are hereby corrected as shown below:

Column 2, line 65, delete "is" (first instance" and insert - are -

Column 3, line 8, delete "of" and insert - or -

Column 3, line 9, after "well-known" insert - inconvenient

Signed and Sealed this

*Twenty-seventh* Day of *December 1983*

[SEAL]

*Attest:*

GERALD J. MOSSINGHOFF

*Attesting Officer* *Commissioner of Patents and Trademarks*